United States Patent [19]

Solomon

[11] 4,345,448

[45] Aug. 24, 1982

[54] CLOSURE ASSEMBLY WITH PROTECTIVE LOCK

[76] Inventor: Martin D. Solomon, 243 Beach 122nd St., Belle Harbor, Queens, N.Y. 11694

[21] Appl. No.: 946,651

[22] Filed: Sep. 28, 1978

Related U.S. Application Data

[63] Continuation of Ser. No. 829,593, Sep. 1, 1977, abandoned.

[51] Int. Cl.[3] ..... E05B 65/08

[52] U.S. Cl. ..... 70/95; 70/2; 70/416; 292/346; 292/DIG. 46

[58] Field of Search ..... 70/2, 6–12, 70/32, 33, 55, 56, 95, 85, 416; 160/133; 292/DIG. 46, 148, 281, 346

[56] References Cited

U.S. PATENT DOCUMENTS

| | | | |
|---|---|---|---|
| 593,722 | 11/1897 | Jefferis | 70/2 X |
| 957,803 | 5/1910 | Schmidt | 70/32 X |
| 2,468,575 | 4/1949 | Sweaney et al. | 292/DIG. 46 |
| 2,670,065 | 2/1954 | Stevens | 160/133 |
| 3,392,555 | 7/1968 | Beaver | 70/56 |
| 3,559,429 | 2/1971 | Hermann | 70/85 |
| 3,606,423 | 9/1971 | McCarthy | 292/148 |
| 3,606,429 | 9/1971 | Palmer | 292/346 X |
| 3,652,114 | 3/1972 | Cady et al. | 70/56 X |
| 3,736,016 | 5/1973 | Garvey et al. | 292/281 |
| 3,751,948 | 8/1973 | Klein | 70/55 |
| 3,769,821 | 11/1973 | Randel | 70/33 |
| 3,817,062 | 6/1974 | Randel | 70/11 |
| 3,863,470 | 2/1975 | Imer | 70/95 X |

FOREIGN PATENT DOCUMENTS

| | | | |
|---|---|---|---|
| 617965 | 8/1935 | Fed. Rep. of Germany | 70/95 |
| 1278821 | 6/1972 | United Kingdom | 292/281 |

*Primary Examiner*—Rodney H. Bonck

*Attorney, Agent, or Firm*—Roylance, Abrams, Berdo & Farley

[57] ABSTRACT

A locking assembly for normally separable apertured structures which protect business fronts against burglary. The locking assembly includes a sturdy, straight pin which penetrates all apertures, and is part of a sturdy bracket which overlies a fixed standard or post. The arrangement is such as to permit a key operated locking device to lie flatly and directly upon the bracket so as to prevent removal of the bracket and its above mentioned pin. The overall arrangement is such as to guard against burglary by an unauthorized person using forceful tools, and to prevent access to the pin for the purpose of destroying or cutting it.

8 Claims, 3 Drawing Figures

CLOSURE ASSEMBLY WITH PROTECTIVE LOCK

This is a continuation of application Ser. No. 829,593, filed Sept. 1, 1977, now abandoned.

BACKGROUND OF THE INVENTION

1. Field of the Invention

The field of the invention is lock-protecting assemblies and more particularly to arrangements where two apertured closure members, one movable and one fixed, are capable of being locked together against relative movement. The field of invention is specifically directed to a movable gate which can be locked to one or more fixed standards for closing the gate, and a lock protecting device is provided for protection against unauthorized entry attempts by burglars.

2. Description of the Prior Art

The art of locking assemblies with guards to prevent unauthorized access to a locking pin by burglar tools, such as a cutting tool, or a chisel or a jimmy, has been well explored. Most of these assemblies, to my knowledge, employ a padlock where the shackle is shielded. In any case, I have not encountered a simple closure assembly which provides adequate protection against an unusually forceful and carefully planned attack on the locking assembly, as hereinafter explained, so as to disable or dismantle it.

This invention is particularly directed to security gates such as are widely used along factory doors, mall grills, store fronts, or the like. The gate is normally closed and locked to one or two standards such as opposing vertical guide tracks by a locking device when the store, for example, is closed, and the gate may be opened by conventional means when the store is opened for business.

To my knowledge, most, if not all, prior arrangements of the above type made unauthorized access difficult, but not to the extent I consider, and is generally considered, essential for adequate protection.

To my further knowledge, the opposing guide tracks of the prior art conventionally, as I do, employ a sturdy, welded, apertured, outwardly extending ear on the outer face of the fixed guide track, serving somewhat as a hasp. However, the locking protective assemblies of which I am aware lacked adequate sturdiness because they did not completely surround and receive the ear so as to take full advantage of the strength of the ear. This defect, and others, are corrected by my device.

SUMMARY OF THE INVENTION

Accordingly, it is an object of this invention to improve the protection means as used on locking assemblies of the type described. My locking assembly provides an adapter in the form of a bracket. A slot is provided to receive and surround the ear of the fixed guide tracks, while still leaving the aperture of the ear exposed. From the underside of one side of the slot, depends a very sturdy pin which penetrates not only both faces of the channel shaped side track, but also an aperture in the movable gate, such gate when closed being sandwiched in the guide tracks. The use of such a penetrating pin, per se, is conventional, but not in combination with a bracket which surrounds the extending ear, and to which the penetrating pin is welded. I thus have a simplified, yet stronger pin arrangement.

The above bracket has yet a further feature. On the side of the slot, opposite the pin position, is a guard or barrier which partially covers the gate receiving channel of the guide tracks. This guard or barrier prevents a burglar from inserting a cutting tool into the channel so as to get at the penetrating pin. However, I do not claim a barrier per se because undoubtedly barriers have been used, but not in connection with an adapter bracket such as in my device.

With the adapter bracket set in place, and the ear aperture exposed, I apply a key-operated lock to the aperture of the ear. This lock, as explained hereinafter, is a thick sturdy disk and has no shackle. Instead, it has an inner, sliding bolt so that the lock can embrace and completely cover the ear while its bolt is not visible, or accessible, but is concealed when the lock is applied. The result is not only concealment of the bolt, but also a closure of such extreme ruggedness that it will defy any burglar tool which I can contemplate. Further, substantially no gap exists, or is available, such as would admit a crowbar or the like.

It must be understood that the lock itself is not my invention as I will explain hereinafter.

The arrangement I have generally described above for one guide track is normally applied to the opposing side track. Also, the invention is particularly useful for roll-up gates as opposed to sliding gates, but it is not specifically limited to roll-up gates.

BRIEF DESCRIPTION OF THE DRAWINGS

Referring to the drawings.

DETAILED DESCRIPTION

Figure 1:
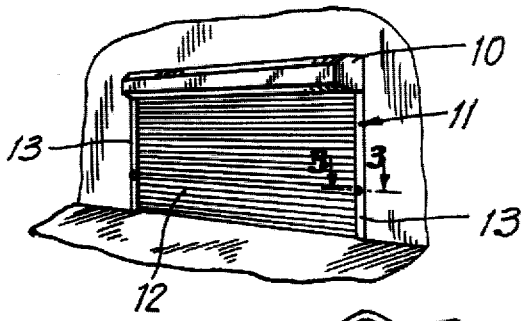
FIG. 1 is a reduced, typical rollable gate in the downward or closed position, such gate comprising hingedly interconnected louvres so that in the trade it is normally referred to as a "solid gate"

Referring first to FIG. 1, the fixed, hollow heading 10 is conventional and it serves to support and enclose the gate 11, when the gate is in the open position. As will be further explained hereinafter, gate 11 actually comprises a hingedly interconnected series of solid, horizontal, vertically arranged concavo-convex louvres 12, the closed gate somewhat appearing to be solid, since the gate cannot be seen through, although closer inspection reveals the interconnections obvious. Such a rollable gate is conventional and is not my invention. An oppositely disposed pair of vertical posts in the form of guide tracks 13 are sturdy and fixed in position. They are channeled and slidingly receive the respective ends of the rollable louvre assembly.

Substantially all prior gates employ opposing hasps or the like when the gate is closed, and most such gates employ a padlock with a generally U-shaped shackle which locks the hasps together. Of course, such a shackle is then exposed, and subject to being cut by a powerful cutting tool, or being sawn through. Accordingly, the art has provided steel shields which may be part of, or separately applied to the padlock, and particularly its shackle. However, to my knowledge, such lock protective shields have left much to be desired since they could be jimmied open, as with a crowbar, or even dismantled by a heavy sledge hammer. My invention corrects such defects.

Figure 2:
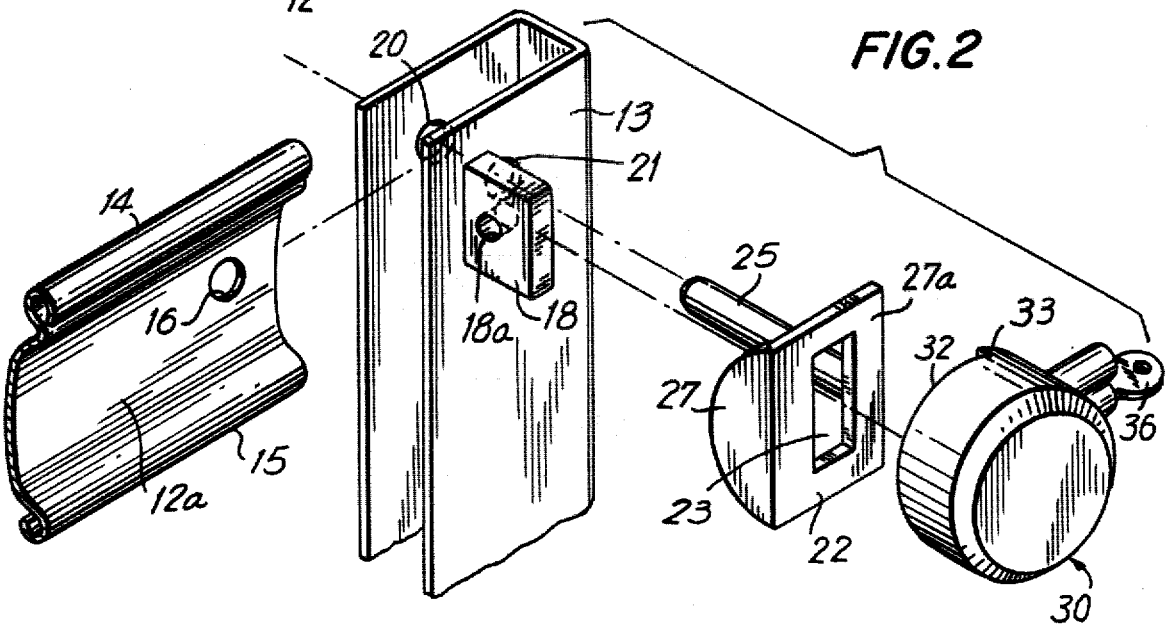
FIG. 2 is an enlarged, dis-assembled view of the closure assembly, one guide track being shown partly broken away.
Figure 3:
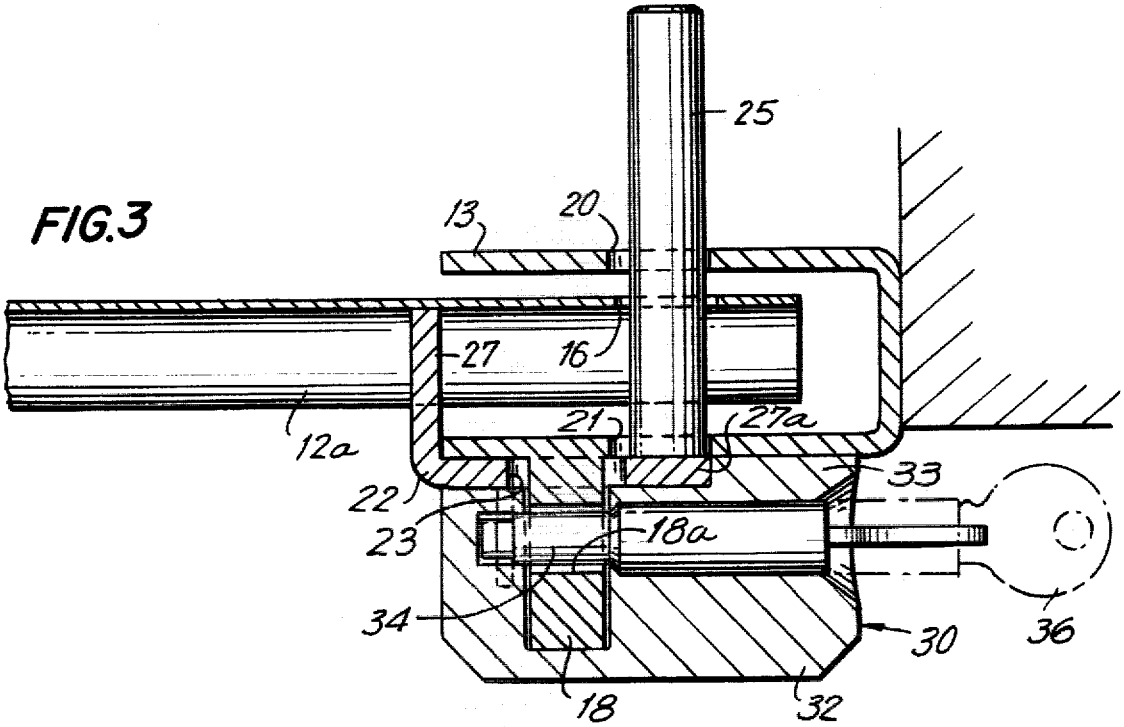
FIG. 3 is a further enlarged view as taken along line 3—3 of FIG. 1.

Referring now to FIGS. 2 and 3, louvre 12a is concave and is of course one of the composite louvre assembly 12. I have selected the concave louvre 12a, a portion of which is shown, as the locking louvre for reasons which will be made evident hereinafter. Its respective hinged channels 14 and 15 interconnect with the other concave louvres as is usual.

My selected louvre 12a is about three feet from the bottom of gate 11 when closed, so that it is conveniently accessible to the business front owner. It is formed with an aperture 16 which registers with the other closure elements in the gate closed position.

Channeled guide track 13 has an apertured sturdy ear 18 welded thereto on one side, which ear functions generally as a hasp. Ear 18 has an aperture 18a. This ear arrangement per se is not new. Guide track 13 has an aperture 20 on its opposite side which is one element of my invention. Similarly, guide track 13 has an aperture 21 on its front face which registers with aperture 20.

A most important element of my invention is a sturdy bracket 22 which acts as an adapter for the application of a special form of lock such as I have described above. Bracket 22 is formed with a central slot 23 which fits over ear 18 so as to receive and embrace ear 18, while the rear side of the front face of bracket 22 lies flatly against guide track 13.

A sturdy, elongated, straight pin 25 is welded or otherwise connected to the underside of bracket 22, at one side of slot 23, and said pin 25 extends perpendicularly relative to the plane of the bracket 22. At the opposite side of bracket 22, or its slot 23, is an arcuate barrier 27 which extends from the underside of the bracket in a plane perpendicular to the bracket.

It can thus be seen that when louvre 12a is in downward, closed position, the manual application of bracket 22 to the ear 18 so that the bracket 22 lies flatly on guide track 13, will cause pin 25 to penetrate aperture 21, aperture 16, and aperture 20, while the slot 23 of bracket 22, leaves the aperture 18a of ear 18 exposed. At the same time, arcuate barrier 27 substantially covers the mouth of guide track 13, in the area of the closure assembly. Barrier 27 also fits at least partially into the concavity of selected louvre 12a, since the bottom edge of the barrier is peripherally arcuate, complementarily to the arcuity of louvre 12a. At this point, we now have a substantially flat, compact closure assembly, which needs only a protective lock. I apply such a lock 30 to the exposed aperture 18a of ear 18.

Lock 30 is not my invention. It is the subject of U.S. Pat. No. 3,769,821 (the manufacturer designating it as Series 2000). It is in the general form of a heavy sturdy, thick disk. For example, it may be about 2⅜ inches in circumference, 1¼-inch thick, and about 1¾ in lbs. in weight.

The underside of lock 30 has a lower layer 32, and a smaller higher layer 33. Lower layer 32 is formed with an underside slot in which the lock bolt 34 is reciprocable, the key 36 of lock 30 functioning to slidably reciprocate lock bolt 34 as the owner desires. As above stated, this is the lock described in said patent.

When lock bolt 34 is directed at aperture 18a, the entire assembly is locked, and the lock bolt 34 is inaccessible to any form of burglaring tool. At the same time, higher layer 33 occupies and covers a substantial portion of the space between the side 27a of bracket 22, which side 27a is short of the side of the guide track 13 opposite the mouth of the guide track as shown in FIG. 3. This permits the bracket 22, together with lock 30, to lie flatly against the adjoining face of guide track 30, as shown in FIG. 3.

The engagement of the guide tracks 13, the gate 12, the bracket 22 and the lock 30 provide both a primary locking mechanism and a secondary or back-up locking mechanism. The primary locking mechanism is provided by the engagement of the pin 25 with the gate aperture 16 and the track hole 21. The secondary or back-up locking mechanism is provided by the engagement of the barrier 27 with the recessed portion of the gate 12.

The above assembly is usually duplicated at the opposite post or guide track to increase the security of the device.

The manually operated lock 30 permits the owner to apply, and then operate, key 36 to lock the bolt 34 into the aperture 18a, and unlock it as desired. Of course, the flat face of bracket 22 is then firmly pressed to the guide track wall, and the louvre 12a is sandwiched or enclosed within said locking assembly, while being protected by barrier 27.

The end result of the above is to make practically impossible invasion of the pin 25 and dismantling of the lock. Indeed, no crevice exists which will permit entry of a burglarizing tool. This is so, because the face of bracket 22 lies flatly against the guide track wall, the lock 30 also maintaining such a flat inner face with respect to the bracket, and to the guide wall. No shackle is accessible so that such means of invasion is not possible. Indeed, even a heavy sledge hammer blow will not dislodge the lock 30 because its concealed bolt 34 is firmly received into aperture 18a. Access to the pin 25 is prevented by barrier 27.

I have shown a preferred embodiment of my invention but it is obvious that numerous changes and omissions may be made therein without departing from its spirit.

What is claimed is:

1. A gate locking system for securely closing an opening comprising a pair of opposed channeled guide tracks, one of said tracks having a fixed ear extending therefrom with an aperture through said ear and having a hole therethrough adjacent said ear;

a gate movable within said tracks between open and closed positions; said gate including at least one recessed portion with an aperture therethrough;

a bracket having a flat plate with a slot therein for receiving said ear, a pin extending perpendicularly from one surface of said plate adjacent said slot, and a barrier member extending from said plate in a plane substantially perpendicular to said plate and from said one surface thereof; said bracket being placed on said one track so that said ear extends through said slot to expose said ear aperture, said pin extends through said gate aperture and said track hole to lock said gate, and said barrier member extends across a portion of the mouth of said one track and engages said gate recessed portion to lock said gate and block access to said pin when said gate is in said closed position; and a lock within which said ear is received with a portion of said lock extending through said ear aperture to secure said bracket to said track;

whereby the engagement of said pin with said gate aperture and said track hole constitutes a primary locking mechanism, and the engagement of said barrier with said recessed portion of said gate provides a back-up locking mechanism as well as blocking access to said pin.

2. A gate locking system according to claim 1, wherein said one track comprises a U-shaped channel having two legs; said track hole extends through each of said legs; and said pin traverses the entire width of said one track.

3. A gate locking system according to claim 1, wherein said bracket plate overlies said one track from said barrier member at the mouth of said one track to a line short of the opposite side of said one track, thereby forming a step at said line; and said lock is in the form of a disk having a stepped undersurface with an underside slot to receive said ear;

whereby said lock lies flat against said bracket and said one track to prevent entry of a burglarizing tool and to prevent rotation therebetween.

4. A gate locking system according to claim 1, wherein said barrier member is convexly curved at its end remote from said plate and said recessed portion of said gate is curved to mate with said end of said barrier member.

5. A gate locking system according to claim 1, wherein said gate comprises a series of concave-convex louvres which are hingedly interconnected.

6. A gate locking system according to claim 1, wherein said bracket is not hinged to said one track to permit said pin to pass through said track hole and said gate aperture while moving along a straight line.

7. A gate locking system according to claim 1, wherein each of said tracks has a duplicate one of said hole, ear, bracket and lock to permit locking at both tracks.

8. A gate locking system according to claim 1, wherein said bracket is held flatly against said one track solely by the action of said lock, and is otherwise freely separable from said one track.

* * * * *